United States Patent [19]

Carroll

[11] 4,090,336

[45] May 23, 1978

[54] INSULATED ROOFING STRUCTURE

[75] Inventor: Frank E. Carroll, Barrington, Ill.

[73] Assignee: Carroll Research, Inc., Rolling Meadows, Ill.

[21] Appl. No.: 567,621

[22] Filed: Apr. 14, 1975

Related U.S. Application Data

[63] Continuation-in-part of Ser. No. 410,874, Oct. 29, 1973, abandoned.

[51] Int. Cl.[2] ..... E04C 1/00

[52] U.S. Cl. ..... 52/309.7; 52/309.12; 52/328; 52/332; 428/141; 428/247; 428/256; 428/304; 428/310; 428/313; 428/321; 428/423

[58] Field of Search ..... 52/309, 328, 408, 411, 52/405, 412, 404, 409, 615, 332; 428/256, 260, 310, 313, 251, 325, 141, 321, 423, 247; 156/71

[56] References Cited

U.S. PATENT DOCUMENTS

| | | | |
|---|---|---|---|
| 2,007,148 | 7/1935 | White et al. | 52/405 |
| 2,174,581 | 10/1939 | Hoge | 52/338 |
| 3,216,167 | 11/1965 | Roberts | 52/612 |
| 3,295,276 | 1/1967 | Muhm | 52/309 |
| 3,466,222 | 9/1969 | Curtis | 52/408 |

*Primary Examiner*—James J. Bell
*Attorney, Agent, or Firm*—Thomas W. Speckman

[57] ABSTRACT

A poured concrete insulated roofing structure installed over roof support members and having gypsum formboard with its underside adjacent the roof support members and secured to with its upper side adjacent rigid synthetic polymer foam, the polymer foam having spaces vertically therethrough over more than about 5 percent of the area of the gypsum formboard, and poured concrete over the foam and extending through the spaces into contact with more than about 5 percent of the formboard.

9 Claims, 3 Drawing Figures

17
16
15
14
15
14
18
13
11
15
12
18

17
16
15
14
20
13
12
21
20

17
16
15
14
51
40
13
12
20
30

INSULATED ROOFING STRUCTURE

CROSS-REFERENCE TO RELATED APPLICATION

This application is a continuation-in-part of my pending application Ser. No. 410,874, filed Oct. 29, 1973 now abandoned.

This invention relates to an insulated roof structure and method providing superior fire protection and insulation properties. The roof structure of this invention is generally a poured concrete roof deck system wherein gypsum formboard is secured to with its upper face adjacent foamed synthetic organic polymer board having spaces vertically therethrough to permit the poured concrete to penetrate to the gypsum formboard at selected intervals.

To obtain most efficient integral insulation properties, prior to this invention conventional metal roof decks were installed followed by foam insulation covered with a weatherproof barrier or traffic layer, such as bitumen and roofing felt. However, such structures do contribute to the spread of a fire in a building under such a metal roof deck. U.S. Pat. No. 3,466,222 is illustrative of recent attempts to overcome such disadvantages. However, the structure shown in the U.S. Pat. No. 3,466,222 only slows down fire damage and does not eliminate it, the roof being susceptible to total destruction by the foam disintegrating and permitting the weatherproofing materials to burn even when utilizing an expensive metal deck roof system.

Poured gypsum roof deck systems have long been recognized as economical and furnishing a fireproof roof structure. In the conventional poured gypsum roof deck system, gypsum formboard is laid over the steel sub-purlin assembly, a layer of interwoven steel reinforcing mesh placed over the gypsum formboard and poured in place slurry of gypsum concrete applied to conventionally two inches thick. Such roof systems are known to provide satisfactory two hour fire ratings and low flame spread ratings. However, attempts to provide insulation to such roof deck systems has not proved satisfactory. One attempt has been to use perlite aggregate in the gypsum concrete, however, this does not give desired insulation properties. Another attempt has been to provide insulation beneath the roof deck structure, however, such insulation either adds to combustion in the interior of the building or is expensive if incombustible mineral fiber is used. Other attempts to provide both satisfactory insulation and fireproof properties have been to utilize formboard which is both incombustible and has insulating properties. Such formboards are those manufactured from mineral fiber materials and fiberglass materials, but these are both expensive and do not provide the desired insulation properties while being more difficult to use in field erection. Also, while fiberglass is incombustible it does not provide any hourly fire rating.

It is an object of this invention to overcome the above disadvantages.

It is a further object of this invention to provide an economical, insulating and fireproof poured gypsum roof deck system providing a 2 hour fire rating.

It is still another object of this invention to provide a poured gypsum roof deck system having integral thermal insulation properties.

It is another object of this invention to provide an insulated gypsum formboard base lightweight concrete poured deck structure.

These and other objects, advantages and features of this invention will be apparent from the description and by reference to the drawings wherein preferred embodiments are shown as:

Figure 1:
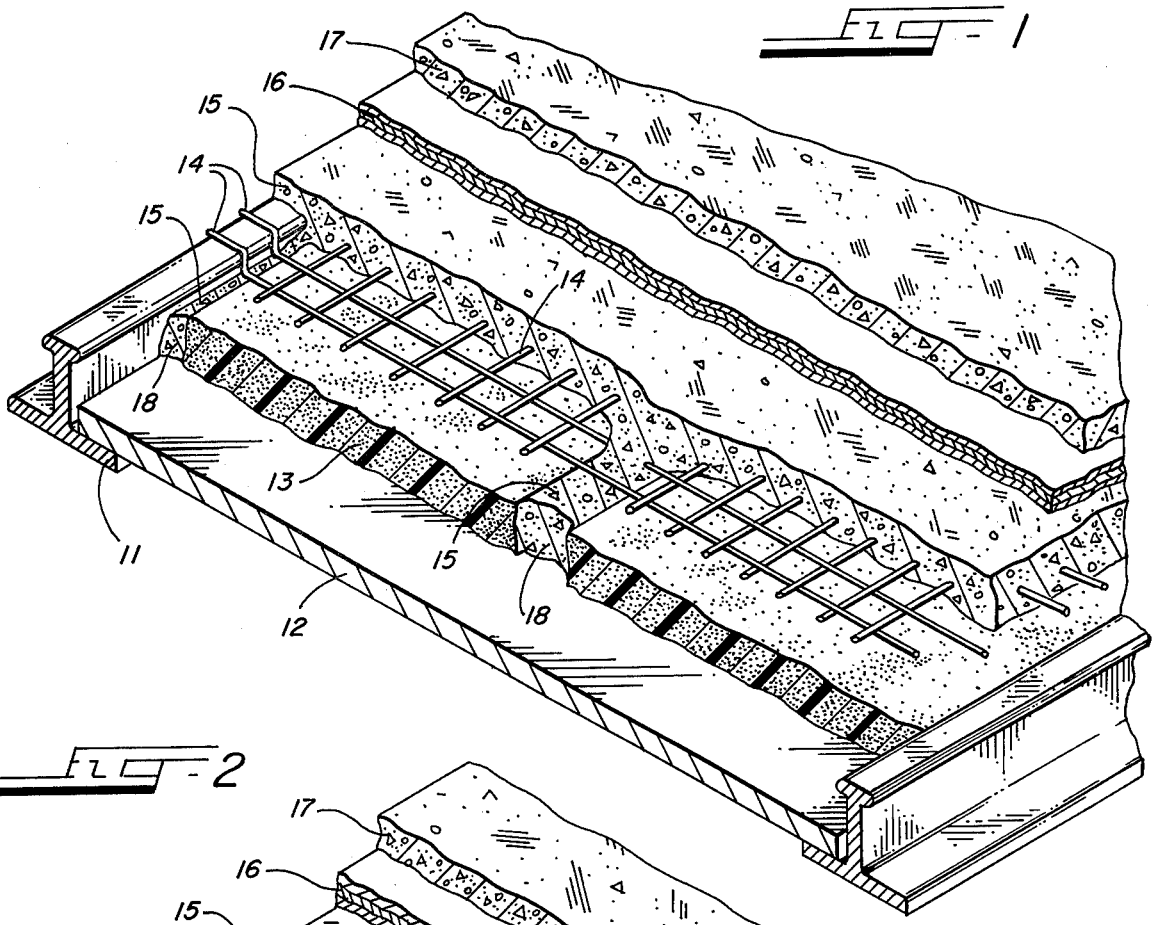
FIG. 1 is a perspective cutaway view of an insulated roofing structure of one preferred embodiment of this invention utilizing bulb tee sub-purlins.

Referring to FIG. 1, bulb tee sub-purlins 11 are supported by any suitable structural members such as open web joists or I beams spaced at proper intervals making a suitable roof support member system. Any roof support member system suitable for support of the gypsum roof is satisfactory. The shape of the tee is not important, for example, trussed tees can advantageously be used in certain installations. Gypsum formboard, shown as 12, having a desired thickness of synthetic organic polymer foam shown as 13 in contact with the upper side of the gypsum formboard is utilized in prepared panels supported by the tee-shaped sub-purlins. The synthetic organic polymer foam has spaces vertically therethrough providing communication between the volume above the polymer foam to the gypsum formboard. It is preferred that the spaces be provided by laminating strips of polymer foam board of desired thickness to the top of the gypsum formboard in an arrangement with about ½ to about 1½ inch, preferably about 1 inch, at all edges of the formboard and about 1½ to about 3 inches, preferably about 2½ inches, between the foam strips. It is desired that the bottom of the spaces communicating from the volume above the polymer foam and the top surface of the formboard have an area of more than about 5 percent of the area of the gypsum board. It is preferred that the bottom of the spaces be about 5 to 20 percent of the surface area of the gypsum board, especially preferred being about 5 to 10 percent of the surface area. It is preferred that the strips of polymer foam be from about 10 inches to about 15 inches in width. Thus, using standard 32 inch wide gypsum formboard, I have found two strips of polymer foam 13.7 inches wide, spaced 1 inch in from each side and ½ inch in from each end leaving a 2½ space between the strips permits satisfactory drying and results in an excellent roof structure.

Any gypsum formboard providing a two hour fire rating when used with poured gypsum slabs is suitable. The least expensive of the gypsum formboards, the rigid ½ inch thick gypsum formboard is suitable for use in the roof structure of this invention, however, various surfaced gypsum formboards having suitable ceiling surfaces may be utilized as long as the incombustibility and flame spread ratings are satisfactory. Gypsum formboard as thin as about ¼ inch can be used in the structure of this invention.

The synthetic organic polymer foam may be any substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polyisocyanurate and the like. Preferred foams are selected from the group consisting of polystyrene and polyurethane. Particularly suitable foams are closed cell foams which provide high insulating properties and low permeability to moisture. Such organic polymer foams are substantially rigid bodies of foam and are well known for their low density and outstanding thermal insulating properties. However, use of organic polymer foams in roof structures has been limited due to the need for care and special attention in installation if they are used alone and due to their decomposition at higher temperatures permitting structural damage. In accordance with this invention these disadvantages are overcome.

The organic polymeric foam and the gypsum formboard are preferably preassembled by fastening the foam to the formboard by any suitable fastening means. Suitable fastening means include synthetic and natural adhesives, wire staples, metal clips and the like. Suitable synthetic adhesives include epoxy, polyurethane, polyamide and polyvinylacetate and its copolymers. Adhesives and wire staples are preferred. It is especially preferred to use adhesives when light weight concrete is used and staples when gypsum concrete is used. The polymer foam and gypsum formboard assembly may be assembled at an assembly plant away from the construction site so that the units utilized at the construction site are in the assembled condition. This requires workmen to merely lay the assembly in place with the gypsum formboard resting upon the roof support members. The polymer foam and gypsum formboard assembly may also be readily assembled at the construction site, especially when fastening with staples or spot adhesive application to gypsum formboard which has been premarked for placement of the foam.

Following installation of the gypsum formboard-polymer foam assembly, standard reinforcing wire used in poured concrete deck assemblies, shown as 14, is applied and concrete poured to a suitable thickness of about 1 to about 3 inches over the surface of the polymer foam, about 2 inches being preferred. The poured concrete 15 flows through spaces 18 in the polymer foam and adheres to the upper surface of the gypsum board 12. This structure provides an integral roofing structure having desired fireproof and internal insulation properties.

The concrete utilized may be preferably standard gypsum concrete, however, modified concretes containing various fillers, such as perlite, aggregate for thermal insulation and lighter weight are suitable, but not necessary in the roof structure of this invention. Gypsum concrete is especially desirable for use in roof structures not only because it is incombustible but also because the gypsum concrete sets within a few minutes to form a slab that is hard enough to walk upon thereby permitting, in many cases, a waterproof wearing surface to be laid the same day the slab is poured. When any type of portland cement is used, the setting time is much slower and to prevent moisture from sagging the formboard, I have found it may be desirable to place a moisture permeable sheet between the cement and the top surface of the formboard. However, I have found that using this invention, lightweight concrete may be poured over gypsum formboard which, to my knowledge, has not previously been possible. The lightweight concrete is especially suitable for the structure shown in FIG. 3. I have found that using the structure of this invention the water dripping from between the formboard sheets is minimized as compared to prior lightweight concrete deck structures.

In FIG. 1, a built-up roofing membrane comprising alternate layers of roofing felt and hot asphalt is shown as 16 with a waterproof wearing surface 17 of tar and gravel. Any suitable waterproof wearing surface for flat type roofs is suitable for the roof structure of this invention, or the concrete may be left exposed, such as on dome type roof structures.

The drying of the concrete continues by removal of moisture from the concrete for several weeks after pouring. I have found that in using the roof structure of this invention the drying time of the concrete is not greatly increased. This results from the concrete being in direct contact with the gypsum formboard which is porous to water. The continued drying of the concrete after a built-up type roofing membrane is applied to its exterior, continues by the moisture escaping through the formboard.

The roof structure of this invention provides an economical roof structure having high insulating properties, two hour fire ratings and providing a structure which may be readily repaired if fire damage does result. Under high heat conditions the organic polymer foam may decompose. However, the strips of concrete filling the vertical slots through the foam and resting upon the gypsum formboard serve to support and unitize the roof structure even if the polymer foam completely disintegrates.

A wide range of desired insulating properties may be achieved by varying the thickness of the polymer foam from about 1 to 3 or 4 inches; however, foam of about 1 to 2 inches thick is preferred for most applications.

Any suitable ceiling structure may be installed beneath the roof structure of this invention as long as suitable ventilation is furnished. However, in contrast to prior roof structures, it is not necessary that the ceiling provide the insulation qualities. The roof structure of this invention provides high insulation and fireproof properties without any structure beneath it and may be left exposed.

My pending application Ser. No. 410,874, filed Oct. 29, 1973 discloses an insulated roof structure wherein the poured concrete flows through holes throughout the polymer foam into contact with the upperside of the gypsum formboard. I have found that the spaces or strips between the polymer foam as taught by this application, provide superior uplift resistance than the structure of my earlier application. I have found that the structure of this invention such as disclosed in FIGS. 1 and 2 wherein the concrete flows around the sub-purlins and comes into contact with the gypsum formboard adjacent to the sub-purlins provides a composite structure having greatly added resistance to deflections, acting as a reinforcement beam. Further, I have found that the concrete extending to the upper surface of the gypsum formboard at about its mid-point of the span between the sub-purlins, also tends to act as a beam and due to its adherence to the upper surface of the gypsum formboard prevents undesired deflection of the formboard and problems of the gypsum formboard falling out from between the sub-purlins. Additional metal reinforcing may be added to these "beam volumes."

Figure 2:
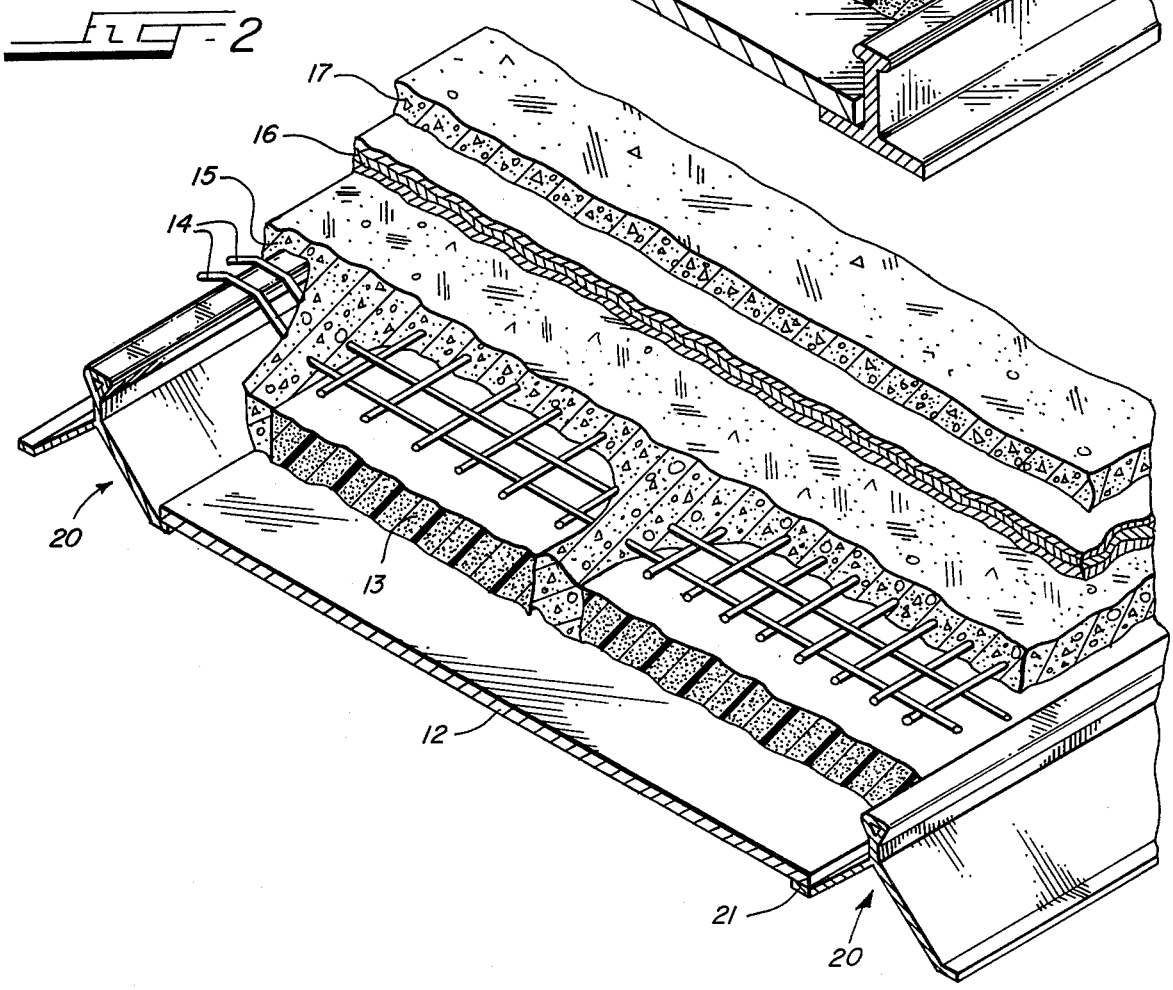
FIG. 2 is a perspective cutaway view of an insulated roofing structure of one preferred embodiment of this invention utilizing sheet metal structural shapes as sub-purlins.

FIG. 2 shows another embodiment of this invention utilizing a sheet metal sub-purlin more fully described in my pending application Ser. No. 457,996, filed Apr. 4, 1974, now U.S. Pat. No. 3,965,641, and provides an improvement over the roof structure shown in my copending application Ser. No. 545,303, filed Jan. 30, 1975, now U.S. Pat. No. 3,962,841. As pointed out above, the increased width of concrete surrounding the sub-purlin provides a stiffer cooperating composite beam structure and the concrete extending to and adhering to the upper surface of the formboard at about the mid-point of its span between the sub-purlins provides a superior unitized structure.

Figure 3:
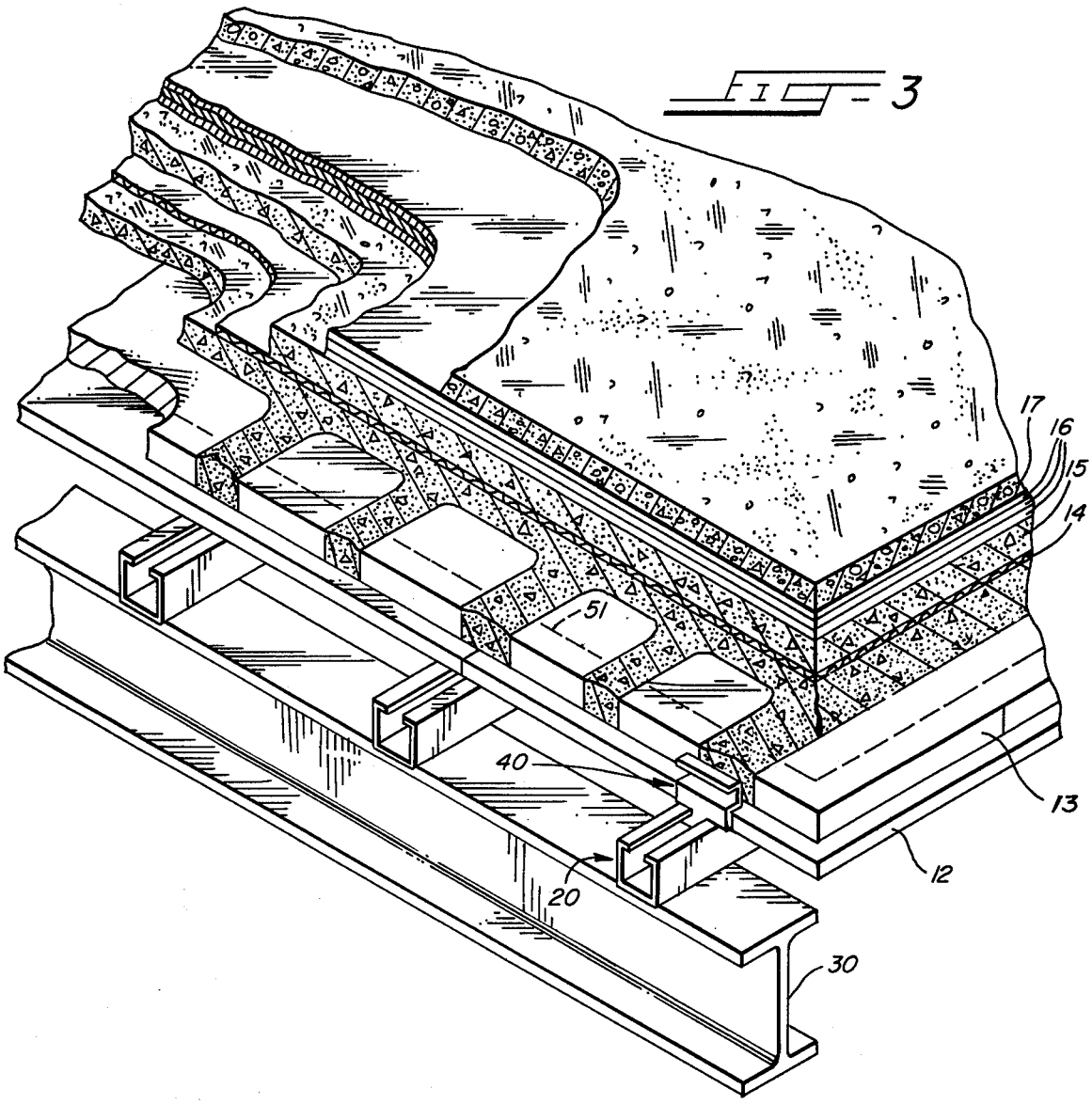
FIG. 3 is a perspective cutaway view of an insulated roofing structure of one embodiment of this invention utilizing box section sub-purlins.

FIG. 3 shows an improvement embodying the features of this invention over the general structure which is more fully described in my copending application Ser. No. 515,892, filed Oct. 18, 1974, now U.S. Pat. No. 3,918,230. The structure of FIG. 3 also provides an additional composite beam structure providing rigidity to the roof system. The structure as shown in FIG. 3 is particularly well suited to the use of lightweight concrete since the sub-purlins are entirely beneath the lower surface of the gypsum formboard and may be arranged on any desired spacing. Thus, a sub-purlin may be spaced at the mid-point of the usual span of the gypsum formboard between sub-purlins and further enhanced by the composite beam effect obtained by utilization of the invention of this application. The clips shown generally as 40 provide further composite reinforcing and uplift resistance of the roof structure by being embedded in the "beam volume."

My prior application, Ser. No. 515,892, teaches an insulated top drying poured roof deck system while all of the roof deck systems of this invention are principally bottom drying systems. Of course, ventilation such as shown in FIG. 3 of Ser. No. 515,892 may be used with any of the roof structures of this invention to provide auxiliary ventilating, but principal drying takes place through the gypsum formboard to the interior of the structure.

Using the structure of this invention as shown in FIG. 3, I have found that ¼ inch gypsum formboard may be used over poured section sub-purlins on 32 inch centers resulting in less than ⅛ inch deflection. Thus, the structure as set forth in FIG. 3 provides a superior structure than present lightweight concrete roof structures which are principally poured over fiberglass formboard which does not provide an hourly fire rating.

The figures and the above description have shown a preferred embodiment of this invention wherein two foam strips are arranged running parallel to adjacent sub-purlins and between them providing a slot at about the center of the span between the sub-purlins. However, for very close spacing such as may be obtained utilizing the system of FIG. 3, one strip of foam may span the distance between the sub-purlins. With wider spacing between the sub-purlins it may be desirable to have as many as three strips of foam between adjacent sub-purlins. While it is preferred that the strips of foam are arranged parallel to the sub-purlins it is also within the scope of this invention to provide strips at right angles to or diagonal to the sub-purlins, the principal requirement being that about 5 to about 20 percent of the upper surface of the formboard be in contact with the concrete. This contact with the poured concrete must be arranged at intervals so that the concrete may dry through such contact points. Further, it is preferred that a "beam volume" be located to include the sub-purlins as in FIGS. 1 and 2 or uplift resistance clips as in FIG. 3 within the "beam volume."

While throughout this disclosure reference has been made to roof deck structures, the identical structure without the waterproofing surfaces may be used for any internal floor deck structure and the terminology "deck structure" used in the appended claims is meant to include both floor and roof deck structures.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A poured insulated deck structure comprising:

deck support members;

moisture permeable gypsum formboard having an underside adjacent said deck support members;

strips of rigid synthetic polymer foam having an underside adjacent the upperside of said gypsum formboard and having openings between said strips providing communication from above said foam to said formboard, said openings having an area of about 5 to 20 percent of the area of said formboard;

reinforcing wire mesh over said foam;

poured concrete adjacent the upperside of said foam and extending through said openings into contact with and adhering to about 5 to 20 percent of the area of the upperside of said gypsum formboard, said concrete continuing drying by escape of moisture through the formboard in the area of contact between the concrete and formboard, said concrete surrounding the portion of the deck support members above said formboard resulting in a reinforced concrete beam structure including the deck support members;

additional concrete beam structures formed by concrete extending through openings between said strips of foam about midway between said deck support members, said additional beam structures adhering to said formboard preventing sagging; and a waterproof wearing surface to the exterior of the poured concrete.

2. The poured insulated deck structure of claim 1 wherein said deck support members are sheet metal structural shapes which are symmetrical about a vertical bisecting plane having a central vertical web, two legs projecting at outward angles downwardly from the bottom of said web, each leg having a substantially horizontal flange projecting outwardly at its lower extremity upon which said formboard rests, and a stiffening member at the upper edge of said web.

3. The deck structure of claim 1 wherein said area of said strips is about 5 to 10 percent.

4. The deck structure of claim 1 wherein said foam is selected from the group consisting of polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, and polyisocyanurate.

5. The deck structure of claim 4 wherein said foam is selected from the group consisting of polystyrene and polyurethane.

6. The deck structure of claim 1 wherein said concrete has a thickness of about 1 to about 3 inches over the surface of the polymer foam.

7. The deck structure of claim 1 wherein said foam has a thickness of about 1 to about 4 inches.

8. The deck structure of claim 1 wherein said concrete is lightweight concrete of a portland cement base.

9. A poured insulated deck structure comprising:

sub-purlins of sheet metal structural shapes of a box section having a horizontal base, opposing vertical sides and upper horizontal flanges extending inwardly from the top of said sides forming an open slot between the terminus of said flanges;

moisture permeable gypsum formboard adjacent to and secured against the top of said upper horizontal flanges of said sub-purlins;

sheet metal clips having a vertical portion extending upwardly and downwardly from opposing slots, each of said opposing slots engaging one of said horizontal flanges of said box section when the axis of said clip and box section are at about 90° to each other, said upwardly extending vertical portion bending to a horizontal portion to engage the top of said formboard securing it against the top of said flanges, then bending to a substantially vertical upward portion and then bending to a substantially horizontal portion to provide uplift resistance when surrounded by concrete;

strips of rigid synthetic polymer foam having an underside adjacent the upperside of said gypsum formboard and having openings between said strips providing communication from above said foam to said formboard, said openings having an area of about 5 to 20 percent of the area of said formboard;

reinforcing wire mesh over said form;

poured concrete adjacent the upperside of said foam and extending through said openings into contact with and adhering to about 5 to 20 percent of the area of the upperside of said gypsum formboard, said concrete continuing drying by escape of moisture through the formboard in the areas of contact between the concrete and formboard, said concrete surrounding the portion of said clips above said formboard resulting in a reinforced concrete beam structure including the deck support members;

additional concrete beam structures formed by concrete extending through openings between said strips of foam about midway between said sub-purlins, said additional beam structures adhering to said formboard preventing sagging; and a waterproof wearing surface to the exterior of the poured concrete.

* * * * *